US007481393B2

(12) United States Patent
Trinko et al.

(10) Patent No.: US 7,481,393 B2
(45) Date of Patent: Jan. 27, 2009

(54) PRODUCE BAG DISPENSING SYSTEM FOR REDUCING WASTED BAGS

(76) Inventors: Thomas Trinko, 1252 Bay Shore Dr., Oshkosh, WI (US) 54901; Dominic Trinko, W2582 Nevada Heights Rd., Iron Ridge, WI (US) 53035

( * ) Notice: Subject to any disclaimer, the term of this patent is extended or adjusted under 35 U.S.C. 154(b) by 913 days.

(21) Appl. No.: 10/834,472

(22) Filed: Apr. 29, 2004

(65) Prior Publication Data

US 2004/0217122 A1 Nov. 4, 2004

Related U.S. Application Data

(60) Provisional application No. 60/467,308, filed on May 2, 2003.

(51) Int. Cl.
*B65H 16/02* (2006.01)

(52) U.S. Cl. ..... 242/588.3; 221/63; 221/155; 206/409; 206/494

(58) Field of Classification Search ..... 242/588, 242/588.3, 588.4; 221/47, 63, 155; 206/390, 206/409, 494, 554
See application file for complete search history.

(56) References Cited

U.S. PATENT DOCUMENTS

| | | | | | |
|---|---|---|---|---|---|
| 3,249,255 | A * | 5/1966 | Cohen | 221/63 |
| 3,826,361 | A * | 7/1974 | Heckrodt | 206/409 |
| 4,175,673 | A * | 11/1979 | McDonald et al. | 221/63 |
| 4,583,642 | A * | 4/1986 | Blythe et al. | 206/409 |
| 4,714,191 | A * | 12/1987 | Richardson | 206/390 |
| 4,850,486 | A * | 7/1989 | Neibaur | 206/390 |
| 4,850,508 | A * | 7/1989 | Lee | 206/390 |
| 5,598,987 | A * | 2/1997 | Wachowicz | |
| 6,016,911 | A * | 1/2000 | Chen | 206/409 |
| 6,168,558 | B1 * | 1/2001 | Vinberg | |
| 6,199,788 | B1 * | 3/2001 | Simhaee | |
| 6,349,849 | B1 * | 2/2002 | Pehr | 221/63 |
| 7,066,422 | B1 | 6/2006 | Slocum | |

* cited by examiner

*Primary Examiner*—William A Rivera
(74) *Attorney, Agent, or Firm*—Quarles & Brady LLP

(57) ABSTRACT

Produce bags are delivered with less waste and in more sanitary condition through a container holding a roll of bags having overlapping but separate ends. Adhesion between the bags and ultimate separation of the bags may be flexibly controlled with an interfolding of the bags and control of an orifice which applies drag to the bags and compression as they are removed.

34 Claims, 1 Drawing Sheet

PRODUCE BAG DISPENSING SYSTEM FOR REDUCING WASTED BAGS

CROSS-REFERENCE TO RELATED APPLICATIONS

This application claims the benefit of U.S. Provisional application 60/467,308 filed May 2, 2003 hereby incorporated by reference.

STATE REGARDING FEDERALLY SPONSORED RESEARCH OR DEVELOPMENT

BACKGROUND OF THE INVENTION

The present invention relates to plastic bags suitable for use by a consumer for packaging produce, including, for example, vegetables and fruit, and in particular the invention relates to an improved produce bag dispensing system.

Produce bags are typically dispensed from rolls positioned in the produce area of a supermarket. Consumers remove the produce bags from the rolls to package produce items they have selected, protecting the produce from dirt and retaining the produce together in the cart. The material of the produce bag is light enough to allow the produce to be weighed in the produce bag at checkout.

Typically, plastic bags for produce are smaller than other plastic bags and made of lighter material. The produce bags are manufactured from an extruded tube of plastic, such as polyethylene, that is heat-sealed and perforated at spaced intervals along the length of the tube. The tube is then rolled into a cardboard form that is suspended on an axle near the produce. Each bag is individually unrolled from the roll, then removed from the other bags of the roll by tearing the bag away along the perforations.

Such a dispensing system is not always satisfactory. A consumer who is holding produce, may need to put the produce down to have both hands free to separate the bag at the perforation, one hand being used to stabilize the roll and the other hand to pull on the bag to be removed. Attempts to separate the produce bags using one hand by a rapid jerk will often fail to fully separate the perforation causing an unrolling of the roll onto the floor, wasting or dirtying of the produce bags.

SUMMARY OF THE INVENTION

The present invention provides an improved dispensing system for produce bags in which the bags are separated from each other during manufacturing, then rolled in overlapping configuration to ensure that the removal of one bag from a container holding the rolls, pulls the next bag partway out of the container, ensuring that the consumer removes only a single bag at a time while allowing the consumer to remove produce bags with a single hand. By using the interleaving technique for smaller produce bags, bag waste is reduced, removal of the bags is made more convenient, and the bags are retained in sanitary condition inside a container before use.

Specifically, the present invention provides a produce bag dispensing system providing a roll of plastic produce bags, each bag having substantially less than 500 square inches of plastic material and the plastic material being substantially less than 15 micron thickness. In the roll, the bags are severed from each other with an end of each bag interleaved with the end of at least one adjacent bag. A container sized to hold the roll provides a constricted opening through which the bags may be dispensed, with edges of the opening dragging on the bags as dispensed. Friction between overlapped portions of each bag is controlled to draw a subsequent bag in the roll partway through the constricted opening upon extraction of a previous bag through the opening by a user and to ensure that the previous bag separates from the subsequent bag before the subsequent bag is fully extracted through the constricted opening.

Thus, it is one object of at least one embodiment of the invention to provide a system of individually dispensing lightweight produce bags.

Each bag may be folded and the region of overlap may interlock the folds of previous bags with the folds of a subsequent bag.

Thus, it is an object of at least one embodiment of the invention to provide a way of increasing frictional contact between lightweight produce bags as may assist individual dispensing.

The fold of one bag may fully envelop the fold of another bag, and the fold of a previous bag may fully cover the fold of a subsequent bag.

It is thus another object of at least one embodiment of the invention to shield the later bag from contact with the restricted opening upon initial removal of a prior bag.

The fold may be a longitudinal V-fold.

It is thus another object of at least one embodiment of the invention to provide an interlocking fold that may be simply integrated into automatic bag-making equipment.

The roll may provide that an open end of each bag precede a closed end of the bag through the opening.

Thus it is another object of at least one embodiment of the invention to make it easier for the consumer to open the bag, especially in a one-handed situation.

The container may be a cardboard box. The constricted opening may be cut in the container.

Thus it is another object of at least one embodiment of the invention to provide a disposable container that may also serve to hold and protect during both shipping and use.

The opening may include a slot cut in a flexible plastic material.

It is thus another object of at least one embodiment of the invention to provide a method of controlling the drag enforced by the constricted opening independent of the material of the container.

The container may have a window.

It is another object of at least one embodiment of the invention to provide a way for a store employee to determine when the roll needs replacing.

The container window may be covered by transparent material.

It is thus another object of at least one embodiment of the invention to provide a window that nevertheless protects the bags from being soiled.

The system may include a stand retaining the container against movement with removal of the bags.

It is another object of at least one embodiment of the invention to provide a system for supporting container in a convenient location for one-handed use.

These particular objects and advantages may apply to only some embodiments falling within the claims and thus do not define the scope of the invention.

DETAILED DESCRIPTION OF THE PREFERRED EMBODIMENT

Figure 1:
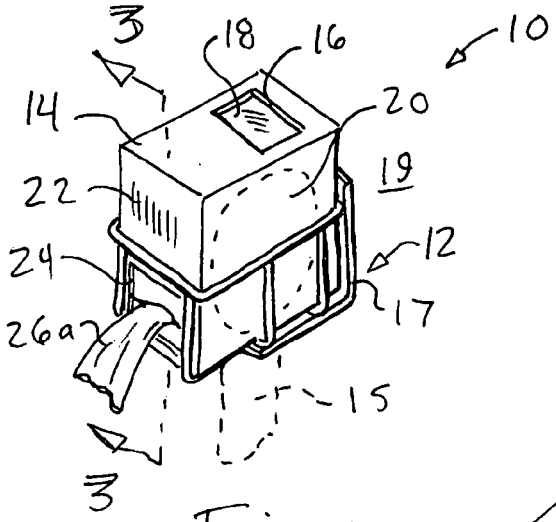
FIG. 1 is a perspective view of a stand supporting a container holding an interleaved coreless roll of produce bags per the present invention.

Referring now to FIG. 1, a produce bag dispensing system 10 provides a stand 12 supporting a container 14 in the vicinity of a produce display. The stand 12 is preferably of welded wire construction with a rear L-bracket 17 allowing the stand 12 to be alternately supported by a vertical pipe 15 attached to a base (not shown) and received by a bottom of the L-bracket 17 or attached to a vertical wall 19 of the store at a rear of the L-bracket 17.

The container 14 is preferably a disposable box constructed of corrugated cardboard or the like. An upper surface of the container 14 includes a window opening 16 covered by a transparent poly film 18 allowing light to enter and exit the container 14 and visual inspection of a contained roll 20 contained therein. A front surface of the container 14 above the wire of the stand 12 displays a promotional message 22 and provides an opening 24 through which bags 26 may be dispensed.

During normal use, a portion of a preceding bag 26*a* will extend from the opening 24 so that it may be grasped by the consumer and the remainder of the preceding bag 26*a* pulled through the opening 24 for use by the consumer. This action draws a succeeding bag 26*b* (not shown) part way out of the container 14, this succeeding bag 26*b* then becoming a preceding bag 26*a* with respect to another succeeding bag 26*b* still in the container 14. It will be understood from this description that as each preceding bag 26*a* is removed, a succeeding bag 26*b* will be partially exposed through the opening 24 in a sequential fashion to be gripped by the user.

Figure 2:
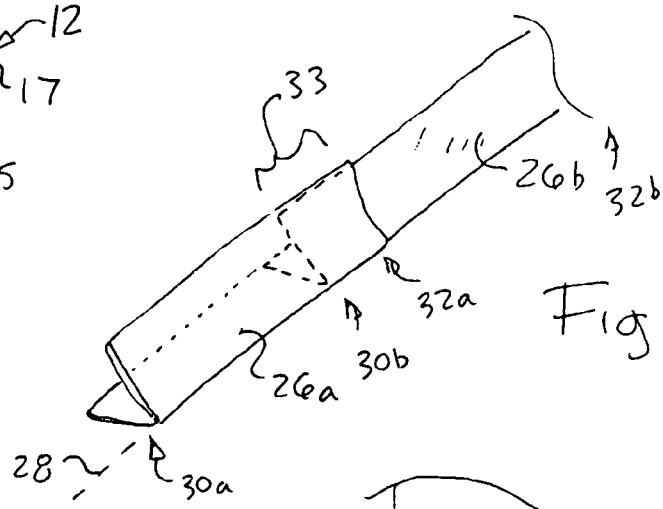
FIG. 2 is a perspective view of two of the bags in the roll, showing their overlap of a V-fold to increasing frictional contact between the bags.

Referring now to FIG. 2, produce bags 26 are typically smaller and of thinner plastic material than other plastic bags having typical bag dimensions of, for example, 12 inches by 20 inches and 10 inches by 15 inches, with 11 micron thickness. Generally, the material of a produce bag 26 will be less than 15 microns, and the total area of material of the produce bag 26 will be less than 500 square inches. This lightweight and slippery material and the small size of the rolls of produce bags can make it difficult to obtain sufficient adhesion between the produce bags 26 so that preceding bag 26*a* carries succeeding bag 26*b* with it through the opening 24 while fully separating after the overlap between the bags 26*a* and 26*b* is through the opening 24.

Accordingly, in one embodiment of the invention, the preceding bag 26*a* and succeeding bag 26*b*, each may have a longitudinal V-fold along a fold line 28 extending from an open end 30 of the bags 26 to a closed end 32 of the bags 26 along the bag's midline. The subsequent bag 26*b* may be inserted in an overlap region 33 into the closed end of the preceding bag 26*a* so that the V-fold of bag 26*b* is fully enclosed by the V-fold of bag 26*a*. In this way, the contact between the bags 26*a* and 26*b* is enhanced and bag 26*a* shields bag 26*b* in part from the effects of being drawn through the opening 24.

Figure 3:
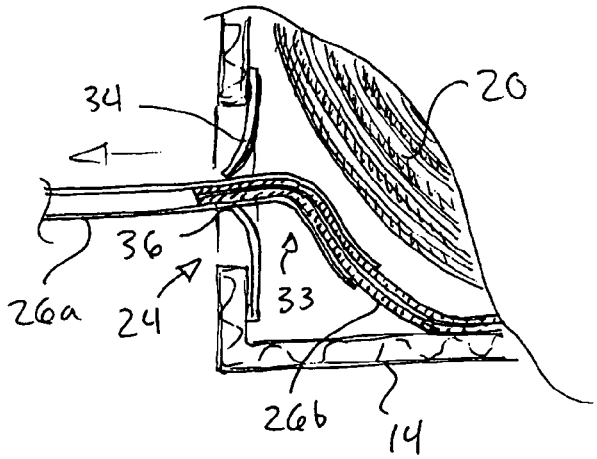
FIG. 3 is a cross-section along line 3-3 of FIG. 1, showing one bag in the process of removal as protects a subsequent bag from contact with a constricted opening of the container of FIG. 1.

Referring now to FIG. 3, the opening 24 of the container 14 through which bags 26 are removed may be constricted to impose a drag on the bags 26 as they are withdrawn from the container 14. In the preferred embodiment, this constriction is provided by a flexible plastic seal 34, being a thin membrane adhered over the opening 24 inside the container 14 and having a slit 36 cut within it so that the bags 26 pass a wiper formed by the lip of the seal 34 at the slit 36. As preceding bag 26*a* is removed the container 14, the lips of the seal 34 rub against only the outsides of the preceding bag 26*a* whereas succeeding bag 26*b* held within bag 26*a* wholly enclosed by its fold is shielded from this drag. The lips of the seal 34 further serve to compress bag 26*a* about subsequent bag 26*b* increasing their frictional contact.

Figure 4:
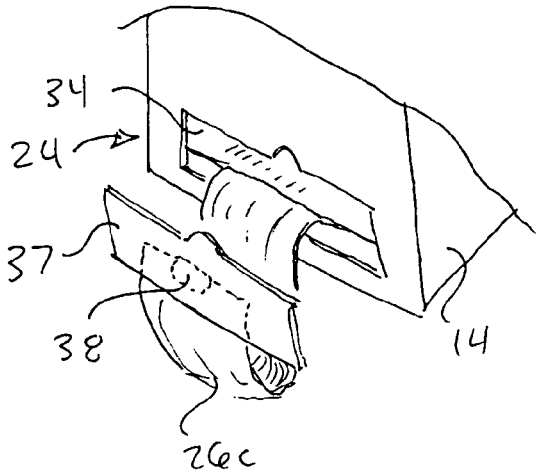
FIG. 4 is a fragmentary perspective view of the opening of the container of FIG. 1 showing the attachment of the first bag of the roll to a removable panel, exposing the opening of the container and drawing the first bag therethrough.

Referring now to FIG. 4, the opening 24 may be initially covered by a panel 37 being a perforated portion of the front of the container 14. A first bag 26*c* may be attached by glue 38 or mechanically, for example with a staple, to the panel 37 so that when the panel 37 is removed from the container 14, a first bag 26*c* is drawn through the poly seal 34. This first bag 26*c* may then be discarded.

It is specifically intended that the present invention not be limited to the embodiments and illustrations contained herein, but include modified forms of those embodiments including portions of the embodiments and combinations of elements of different embodiments as come within the scope of the following claims.

We claim:

1. A produce bag dispensing system comprising:

a roll of plastic produce bags formed of fully-severed individual bags, each bag having substantially less than 500 square inches of plastic material and the plastic material being substantially of less than 15 micron thickness;

a container sized to hold the roll of plastic produce bags and providing an opening through which the bags may be dispensed;

wherein each bag in the roll of plastic bags includes a longitudinal fold and wherein adjacent bags in the roll of plastic bags are interleaved along the longitudinal folds to form overlapped portions that interlock adjacent bags through the longitudinal folds; and wherein a friction between overlapped portions of each bag is configured to draw a subsequent bag in the roll of plastic bags partially through the opening upon extraction of an adjacent bag through the opening and be overcome to separate the adjacent bag from the subsequent bag before the subsequent bag is fully extracted through the opening.

2. The system of claim 1 wherein the longitudinal fold forms a single fold formed in each bag.

3. The system of claim 1 wherein the longitudinal fold includes a V-fold formed along an approximate longitudinal center of each bag.

4. The system of claim 1 wherein the opening is configured to restrict access into the container while permitting bags in the roll of plastic bags to be extracted from the container.

5. A produce bag dispensing system comprising:

a roll of plastic produce bags formed of fully-severed individual bags, each bag having substantially less than 500 square inches of plastic material and the plastic material being substantially less than 15 micron thickness;

a container sized to hold the roll of plastic produce bags and providing an opening through which the bags may be dispensed;

a basket configured to support the container and having a plurality of walls configured to restrict the container from being inadvertently disengaged with the basket; and wherein a friction between overlapped portions of each bag is configured to draw a subsequent bag in the roll of plastic bags partially through the opening upon extraction of an adjacent bag through the opening and be overcome to separate the adjacent bag from the subsequent bag before the subsequent bag is fully extracted through the opening.

6. The system of claim 5 wherein each bag in the roll of plastic bags includes a longitudinal fold and wherein adjacent bags in the roll of plastic bags are interleaved along the longitudinal folds form overlapped portions that interlock adjacent bags through the longitudinal folds.

7. The system of claim 6 wherein the longitudinal fold forms a single fold formed in each bag.

8. The system of claim 6 wherein the longitudinal fold includes a V-fold formed along an approximate longitudinal center of each bag.

9. The produce bag dispensing system of claim 6 wherein the fold of one bag fully envelops the fold of another bag.

10. The produce bag dispensing system of claim 9 wherein the fold of the previous bag fully covers the fold of the subsequent bag.

11. The produce bag dispensing system of claim 6 wherein the fold is a longitudinal V-fold.

12. The produce bag dispensing system of claim 6 wherein the roll provides that an open end of each bag precede a closed end of each bag through the opening.

13. The system of claim 5 wherein the opening is configured to restrict access into the container while permitting bags in the roll of plastic bags to be extracted from the container.

14. The produce bag dispensing system of claim 5 wherein the opening includes a slot cut in a flexible plastic material.

15. The produce bag dispensing system of claim 5 wherein the container includes a window.

16. The produce bag dispensing system of claim 15 wherein the container window is covered by a transparent material.

17. The produce bag dispensing system of claim 5 wherein further including a stand for supporting the basket near produce.

18. A produce bag dispensing system comprising:

a roll of plastic produce bags formed of fully-severed individual bags, each bag formed of a plastic material being substantially less than 15 microns thick and each bag including a longitudinal fold;

a container sized to hold the roll of plastic produce bags and providing an opening through which the bags may be dispensed;

wherein adjacent bags in the roll of plastic bags are interleaved along the longitudinal folds to form overlapped portions that interlock adjacent bags through the longitudinal folds; and wherein a friction between overlapped portions of each bag is configured to draw a subsequent bag in the roll of plastic bags partially through the opening upon extraction of an adjacent bag through the opening and be overcome to separate the adjacent bag from the subsequent bag before the subsequent bag is fully extracted through the opening.

19. The produce bag dispensing system of claim 18 wherein the fold of one bag fully envelops the fold of another bag.

20. The produce bag dispensing system of claim 19 wherein the fold of the previous bag fully covers the fold of the subsequent bag.

21. The produce bag dispensing system of claim 19 wherein the fold is a longitudinal V-fold.

22. The produce bag dispensing system of claim 18 wherein the roll provides that an open end of each bag precede a closed end of each bag through the opening.

23. The produce bag dispensing system of claim 18 wherein the opening includes a slot cut in a flexible plastic material.

24. The produce bag dispensing system of claim 18 wherein the container includes a window.

25. The produce bag dispensing system of claim 24 wherein the container window is covered by a transparent material.

26. The produce bag dispensing system of claim 18 further including a stand for supporting the container near produce.

27. The produce bag dispensing system of claim 18 further comprising a basket configured to support the container.

28. The produce bag dispending system of claim 27 wherein the basket includes a plurality of walls configured to restrict the container from being inadvertently disengaged with the basket.

29. The produce bag dispending system of claim 28 wherein the basket is configured to allow the container to be readily removed and replaced by lifting the container from the basket.

30. The system of claim 18 wherein the longitudinal fold forms a single fold formed in each bag.

31. The system of claim 18 wherein the longitudinal fold includes a V-fold formed along an approximate longitudinal center of each bag.

32. The system of claim 18 wherein the opening is configured to restrict access into the container while permitting bags in the roll of plastic bags to be extracted from the container.

33. A produce bag dispensing system comprising:

a roll of plastic produce bags formed of fully-severed individual bags, each bag formed of a plastic material being substantially less than 15 microns thick;

a container sized to hold the roll of plastic produce bags and providing an opening through which the bags may be dispensed;

a basket configured to support the container and having a plurality of walls configured to restrict the container from being inadvertently disengaged with the basket; and wherein a friction between overlapped portions of each bag is configured to draw a subsequent bag in the roll of plastic bags partially through the opening upon extraction of an adjacent bag through the opening and be overcome to separate the adjacent bag from the subsequent bag before the subsequent bag is fully extracted through the opening.

34. The system of claim 33 wherein each bag in the roll of plastic bags includes a longitudinal fold and wherein adjacent bags in the roll of plastic bags are interleaved along the longitudinal folds form overlapped portions that interlock adjacent bags through the longitudinal folds.

* * * * *